US012774541B2

(12) United States Patent
Terada et al.

(10) Patent No.: US 12,774,541 B2
(45) Date of Patent: Oct. 27, 2026

(54) FIBER PRODUCT

(71) Applicant: Panasonic Intellectual Property Management Co., Ltd., Osaka (JP)

(72) Inventors: Tsuyoshi Terada, Osaka (JP); Akitoshi Kasahara, Osaka (JP); Kenshiro Takeda, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 18/866,529

(22) PCT Filed: May 17, 2023

(86) PCT No.: PCT/JP2023/018419
§ 371 (c)(1),
(2) Date: Nov. 16, 2024

(87) PCT Pub. No.: WO2023/228834
PCT Pub. Date: Nov. 30, 2023

(65) Prior Publication Data

US 2025/0327218 A1 Oct. 23, 2025

(30) Foreign Application Priority Data

May 25, 2022 (JP) ..... 2022-085457

(51) Int. Cl.
*D02G 3/12* (2006.01)
*D02G 3/38* (2006.01)

(52) U.S. Cl.
CPC ..... *D02G 3/12* (2013.01); *D02G 3/38* (2013.01)

(58) Field of Classification Search
CPC ..... D02G 3/12; D02G 3/441
USPC ..... 57/210, 212
See application file for complete search history.

(56) References Cited

U.S. PATENT DOCUMENTS 3,582,445 A * 6/1971 Okuhashi ..... D06Q 1/04 57/244
4,640,179 A * 2/1987 Cameron ..... D04C 1/12 87/8
5,628,172 A * 5/1997 Kolmes ..... D04B 1/28 2/167
5,699,680 A * 12/1997 Guerlet ..... C01C 3/0216 57/212
5,806,296 A * 9/1998 Kaneko ..... D07B 1/062 57/212

(Continued)

FOREIGN PATENT DOCUMENTS

CN 210684056 U * 6/2020 ..... D02G 3/442
CN 113025859 A 6/2021

(Continued)

OTHER PUBLICATIONS

Sen'i Binran (Fiber Handbook), Third edition, The Society of Fiber Science and Technology Japan, 2004, pp. 918 and 919, with partial English translation.

(Continued)

*Primary Examiner* — Grace Huang
(74) *Attorney, Agent, or Firm* — Renner, Otto, Boisselle & Sklar, LLP

(57) ABSTRACT

A fiber product includes a tungsten wire having an elongation percentage greater than or equal to 5%, and an organic fiber that is combined with the tungsten wire.

6 Claims, 12 Drawing Sheets

(56) References Cited

U.S. PATENT DOCUMENTS

| | | | | |
|---|---|---|---|---|
| 7,842,628 | B2 * | 11/2010 | Yasui | A41B 17/00 442/310 |
| 7,913,483 | B2 * | 3/2011 | Qiu | D02G 3/367 57/18 |
| 9,161,752 | B2 * | 10/2015 | Esaki | C22F 1/18 |
| 10,011,925 | B2 * | 7/2018 | Kurahashi | H01B 3/48 |
| 10,723,042 | B2 * | 7/2020 | Kanazawa | B28D 5/045 |
| 10,967,447 | B2 * | 4/2021 | Kanazawa | B28D 5/045 |
| 11,479,886 | B2 * | 10/2022 | Abouraddy | D04B 1/12 |
| 2006/0137319 | A1 * | 6/2006 | Hirota | D02G 3/04 57/210 |
| 2008/0072628 | A1 * | 3/2008 | Liu | D02G 3/10 28/100 |
| 2012/0225275 | A1 * | 9/2012 | Honma | D02G 3/12 428/222 |
| 2018/0135211 | A1 | 5/2018 | Terada et al. | |
| 2018/0326519 | A1 * | 11/2018 | Kanazawa | B23D 65/00 |
| 2020/0199790 | A1 | 6/2020 | Hayashi | |
| 2021/0380846 | A1 * | 12/2021 | Takashima | C09J 7/21 |
| 2022/0098708 | A1 * | 3/2022 | Kanazawa | B21C 9/00 |
| 2023/0002867 | A1 | 1/2023 | Kasahara et al. | |

FOREIGN PATENT DOCUMENTS

| | | | | |
|---|---|---|---|---|
| EP | 2567945 | A2 * | 3/2013 | D03D 1/00 |
| JP | 54-94782 | A | 7/1979 | |
| JP | 2018-080413 | A | 5/2018 | |
| JP | 6930735 | B2 | 8/2021 | |
| TW | 201920788 | A | 6/2019 | |
| TW | 202122600 | A | 6/2021 | |
| WO | 2013/039195 | A1 | 3/2013 | |
| WO | WO-2016202627 | A1 * | 12/2016 | D03D 15/513 |

OTHER PUBLICATIONS

Explanation of fiber length (long fiber, short fiber)—Natural materials edition, ApparelX News, Feb. 2021, 11 pages, <URL: https://apparelx-news.jp/apparel-material/threads/natural_fiber_length>.

Basic knowledge of hemp—Japan Hemp Spinners Association, Japan Linen Spinning Association, Japan Bast Fiber Association, 2020, 9 pages, <URL: https://asabo.jp/knowledge/>.

The history, appeal and effects of hemp—Binchotan.com, "publication date unknown", "document recognition date: Apr. 26, 2022" , 7 pages, <URL: https://www.binchoutan.com/hemp/info.html>.

Fiber performance—elongation, "publication date unknown" , "document recognition date: Apr. 26, 2022", 1 page, <URL: http://www2d.biglobe.ne.jp/~chem_env/i/fiber02.html>.

Comparison of tensile strength of fibers, Comparison of fiber tensile strength—List of fiber tensile strength, Dec. 2015, 5 pages, <URL: https://www.toishi.info/sozai/textile/textile_tensile.html>.

International Search Report issued on Aug. 15, 2023 in International (PCT) Application No. PCT/JP2023/018419.

* cited by examiner

FIG. 5

| Organic fiber | Elongation percentage [%] |
|---|---|
| Polyester | Normal: 20 to 32<br>Strong: 7 to 17 |
| Polyethylene (high density) | 8~35 |
| Polypropylene | Normal: 25 to 60<br>Strong: 15 to 25 |
| Nylon | Normal: 28 to 45<br>Strong: 16 to 25 |
| Cotton (upland) | 3~7 |
| Wool (merino) | 25~35 |
| Silk | 15~25 |
| Hemp (flax) | 1.5~2.3 |
| Rayon | 18~24 |

FIG. 6

| Turns per predetermined length | Lp [mm] | Rp [mm] | Lp／Rp |
|---|---|---|---|
| 21 turns/inch | 1.21 | 0.3 | 4.03 |
| 21 turns/inch | 1.21 | 0.8 | 1.51 |
| 21 turns/inch | 1.21 | 1.2 | 1.01 |
| 18 turns/inch | 1.41 | 0.3 | 4.70 |
| 18 turns/inch | 1.41 | 0.8 | 1.76 |
| 18 turns/inch | 1.41 | 1.2 | 1.18 |
| 100 turns/m | 10.00 | 0.3 | 33.33 |
| 100 turns/m | 10.00 | 0.8 | 12.50 |
| 100 turns/m | 10.00 | 1.2 | 8.33 |
| 1000 turns/m | 1.00 | 0.3 | 3.33 |
| 1000 turns/m | 1.00 | 0.8 | 1.25 |
| 1000 turns/m | 1.00 | 1.2 | 0.83 |

FIG. 7

| Tp \ Lp/Rp | 1 | 2 | 2.5 | 3 | 5 | 10 | 50 | 100 |
|---|---|---|---|---|---|---|---|---|
| 0% | 0.0% | 0.0% | 0.0% | 0.0% | 0.0% | 0.0% | 0.0% | 0.0% |
| 2% | -0.7% | -0.1% | 0.2% | 0.4% | 1.2% | 1.7% | 2.0% | 2.0% |
| 4% | -1.4% | -0.2% | 0.4% | 0.9% | 2.4% | 3.5% | 4.0% | 4.0% |
| 6% | -2.0% | -0.2% | 0.7% | 1.5% | 3.6% | 5.2% | 6.0% | 6.0% |
| 8% | -2.6% | -0.2% | 1.0% | 2.0% | 4.8% | 7.0% | 8.0% | 8.0% |
| 10% | -3.2% | -0.2% | 1.3% | 2.6% | 6.1% | 8.8% | 9.9% | 10.0% |
| 12% | -3.8% | -0.1% | 1.6% | 3.2% | 7.3% | 10.5% | 11.9% | 12.0% |
| 14% | -4.3% | 0.0% | 2.0% | 3.9% | 8.6% | 12.3% | 13.9% | 14.0% |
| 16% | -4.8% | 0.1% | 2.4% | 4.5% | 9.9% | 14.1% | 15.9% | 16.0% |
| 18% | -5.3% | 0.2% | 2.9% | 5.2% | 11.3% | 15.9% | 17.9% | 18.0% |
| 20% | -5.7% | 0.4% | 3.4% | 6.0% | 12.6% | 17.7% | 19.9% | 20.0% |
| 22% | -6.1% | 0.6% | 3.9% | 6.7% | 14.0% | 19.5% | 21.9% | 22.0% |
| 24% | -6.5% | 0.9% | 4.4% | 7.5% | 15.4% | 21.3% | 23.9% | 24.0% |
| 26% | -6.9% | 1.1% | 5.0% | 8.3% | 16.7% | 23.1% | 25.9% | 26.0% |
| 28% | -7.3% | 1.4% | 5.5% | 9.1% | 18.1% | 25.0% | 27.9% | 28.0% |
| 30% | -7.6% | 1.7% | 6.1% | 9.9% | 19.6% | 26.8% | 29.9% | 30.0% |
| 32% | -7.9% | 2.1% | 6.7% | 10.8% | 21.0% | 28.6% | 31.9% | 32.0% |
| 34% | -8.2% | 2.4% | 7.4% | 11.7% | 22.4% | 30.4% | 33.8% | 34.0% |
| 36% | -8.5% | 2.8% | 8.0% | 12.6% | 23.9% | 32.3% | 35.8% | 36.0% |
| 38% | -8.7% | 3.2% | 8.7% | 13.5% | 25.3% | 34.1% | 37.8% | 38.0% |
| 40% | -9.0% | 3.6% | 9.4% | 14.4% | 26.8% | 35.9% | 39.8% | 40.0% |

FIG. 8

| Tp \ Lp/Rp | 1 | 2 | 2.5 | 3 | 5 | 10 | 50 | 100 |
|---|---|---|---|---|---|---|---|---|
| 0% | 0.0% | 0.0% | 0.0% | 0.0% | 0.0% | 0.0% | 0.0% | 0.0% |
| 5% | -1.7% | -0.2% | 0.5% | 1.2% | 3.0% | 4.4% | 5.0% | 5.0% |
| 10% | -3.2% | -0.2% | 1.3% | 2.6% | 6.1% | 8.8% | 9.9% | 10.0% |
| 15% | -4.5% | 0.0% | 2.2% | 4.2% | 9.3% | 13.2% | 14.9% | 15.0% |
| 20% | -5.7% | 0.4% | 3.4% | 6.0% | 12.6% | 17.7% | 19.9% | 20.0% |
| 25% | -6.7% | 1.0% | 4.7% | 7.9% | 16.0% | 22.2% | 24.9% | 25.0% |
| 30% | -7.6% | 1.7% | 6.1% | 9.9% | 19.6% | 26.8% | 29.9% | 30.0% |
| 35% | -8.3% | 2.6% | 7.7% | 12.1% | 23.1% | 31.4% | 34.8% | 35.0% |
| 40% | -9.0% | 3.6% | 9.4% | 14.4% | 26.8% | 35.9% | 39.8% | 40.0% |
| 45% | -9.5% | 4.7% | 11.2% | 16.8% | 30.5% | 40.6% | 44.8% | 45.0% |
| 50% | -9.9% | 6.0% | 13.2% | 19.2% | 34.2% | 45.2% | 49.8% | 49.9% |
| 55% | -10.2% | 7.3% | 15.2% | 21.8% | 38.0% | 49.8% | 54.8% | 54.9% |
| 60% | -10.4% | 8.8% | 17.3% | 24.4% | 41.9% | 54.5% | 59.8% | 59.9% |
| 65% | -10.5% | 10.3% | 19.4% | 27.1% | 45.7% | 59.1% | 64.7% | 64.9% |
| 70% | -10.6% | 11.9% | 21.7% | 29.8% | 49.6% | 63.8% | 69.7% | 69.9% |
| 75% | -10.5% | 13.6% | 24.0% | 32.6% | 53.5% | 68.5% | 74.7% | 74.9% |
| 80% | -10.4% | 15.3% | 26.3% | 35.5% | 57.5% | 73.2% | 79.7% | 79.9% |
| 85% | -10.2% | 17.1% | 28.8% | 38.4% | 61.5% | 77.9% | 84.7% | 84.9% |
| 90% | -10.0% | 19.0% | 31.2% | 41.3% | 65.4% | 82.6% | 89.7% | 89.9% |
| 95% | -9.7% | 20.9% | 33.7% | 44.3% | 69.5% | 87.3% | 94.7% | 94.9% |
| 100% | -9.3% | 22.9% | 36.3% | 47.3% | 73.5% | 92.0% | 99.7% | 99.9% |

FIBER PRODUCT

TECHNICAL FIELD

The present invention relates to a fiber product.

BACKGROUND ART

Patent Literature (PTL) 1 discloses a metal fiber in which a tungsten wire having a roughened surface, and an aramid fiber or a nylon-based fiber are combined together.

Citation List

Patent Literature

[PTL 1] Japanese Unexamined Patent Application Publication No. 2018-080413

SUMMARY OF INVENTION

Technical Problem

In general, tungsten wires are low in ductility. Thus, a tungsten wire may fail to be elongated along with the elongation and contraction of a fiber and thereby break.

In view of this, the present invention has an object to provide a fiber product capable of suppressing the occurrence of breaking of a tungsten wire.

Solution to Problem

A fiber product according to an aspect of the present invention includes: a tungsten wire having an elongation percentage greater than or equal to 5%; and an organic fiber that is combined with the tungsten wire.

Advantageous Effects of Invention

The fiber product according to the present invention is capable of suppressing the occurrence of breaking of a tungsten wire.

BRIEF DESCRIPTION OF DRAWINGS

FIG. 5 is a table showing maximum values of elongation percentages of types of fibers that can be used as an organic fiber.

FIG. 6 is a table showing examples of Lp/Rp of a wrapped yarn in a case where a tungsten wire is wound around each of a plurality of organic fibers having different diameters with a predetermined number of turns.

FIG. 7 is a table showing elongation percentage Tw required for the tungsten wire at elongation percentages Tp of the organic fiber within a range of 0% to 40%.

FIG. 8 is a table showing elongation percentage Tw required for the tungsten wire at elongation percentages Tp of the organic fiber within a range of 0% to 100%.

DESCRIPTION OF EMBODIMENTS

Hereinafter, a fiber product according to embodiments of the present invention will be described in detail with reference to the Drawings. It should be noted that each of the embodiments described shows a specific example of the present invention. Therefore, numerical values, shapes, materials, elements, the arrangement and connection of the elements, steps, the processing order of the steps, etc., indicated in the following embodiments are mere examples, and thus are not intended to limit the present invention. Accordingly, among the elements described in the following embodiments, elements not recited in any independent claim are described as optional elements.

Furthermore, the figures are schematic illustrations and are not necessarily accurate depictions. Therefore, for example, the scaling, etc., in the figures is not necessarily uniform. Elements which are substantially the same have the same reference signs in the figures, and duplicate description may be omitted or simplified.

In the Written Description, terms indicating relationships between elements, terms indicating shapes of elements, and numerical ranges are expressions that refer not only to their strict meanings, but encompass a range of essentially equivalents, such as a range of deviations of a few percent.

EMBODIMENT

[Wrapped Yarn]

Figure 1:
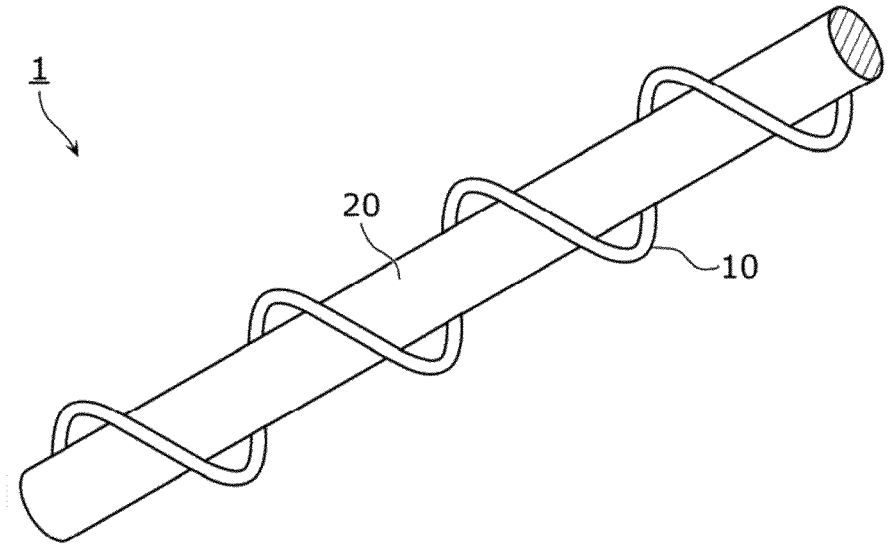
FIG. 1 is a schematic diagram of a wrapped yarn according to an embodiment.

First, with reference to FIG. 1, a configuration of a wrapped yarn according to the present embodiment will be described. FIG. 1 is a schematic diagram illustrating wrapped yarn 1 according to the present embodiment.

As illustrated in FIG. 1, wrapped yarn 1 includes tungsten wire 10 and organic fiber 20 that is combined with tungsten wire 10. Tungsten wire 10 and organic fiber 20 constitute wrapped yarn 1.

In the present embodiment, wrapped yarn 1 is a covered yarn in which organic fiber 20 is a core yarn and tungsten wire 10 is a sheath yarn. Wrapped yarn 1 is manufactured by, for example, extending and fixing organic fiber 20 as the core yarn and winding tungsten wire 10 around organic fiber 20 as the sheath yarn (that is, performing a covering process).

Tungsten wire 10 is wound along an outer surface of organic fiber 20 with a predetermined pitch. As illustrated in FIG. 1, tungsten wire 10 is wound with a gap between adjacent turns. However, the adjacent turns may be in close contact with each other.

A specific configuration and a specific manufacturing method of tungsten wire 10 will be described later.

Organic fiber 20 is at least one fiber selected from a group containing a synthetic fiber, a natural fiber, and a recycled fiber. Organic fiber 20 is, for example, a synthetic fiber such as an aramid fiber or a nylon-based fiber. As the aramid fiber, for example, a fiber manufactured using an aromatic polyamide-based resin material such as Kevlar (registered trademark) can be used. As the nylon-based fiber, for example, a fiber manufactured using an ultra-high-molecular-weight polyethylene such as Dyneema (registered trademark) can be used.

It should be noted that a chemical fiber used as organic fiber 20 is not limited to these, and other chemical fibers such as polyethylene, polyester, polypropylene, polyurethane, polyvinyl chloride, or acrylic can be used. Alternatively, organic fiber 20 may be a semi-synthetic fiber or a recycled fiber. Furthermore, organic fiber 20 may be a natural fiber such as a plant fiber or an animal fiber. For example, as organic fiber 20, cotton, wool, silk, hemp, rayon, or the like can be used.

In the example illustrated in FIG. 1, organic fiber 20 is a monofilament. However, organic fiber 20 is not limited to this. Organic fiber 20 may be a multifilament, that is, an aggregate of a plurality of monofilaments. When organic fiber 20 is a monofilament, organic fiber 20 has an elongation percentage less than or equal to 70%, for example.

It should be noted that the elongation percentage is equivalent to a total elongation at fracture and is measured with an extensometer. Specifically, the elongation percentage of organic fiber 20 is the total elongation at the time of fracture of organic fiber 20. The elongation percentage is a value of a total of an elastic elongation and a plastic elongation measured by the extensometer with respect to an extensometer gauge length, expressed as a percentage. In short, the elongation percentage refers to a proportion of a difference between a length after elongation and a length before elongation with respect to the length before elongation. An elongation percentage of a positive value means that a thread has been elongated, and an elongation percentage of a negative value means that a thread has been shortened. This holds true for an elongation percentage of tungsten wire 10.

In the present embodiment, a diameter of organic fiber 20 is larger than a diameter of tungsten wire 10, for example, greater than or equal to 100 μm. However, the diameter of organic fiber 20 is not limited to this. It should be noted that the diameter of organic fiber 20 may be equal to the diameter of tungsten wire 10 or may be less than the diameter of tungsten wire 10.

When organic fiber 20 is a monofilament, the diameter of organic fiber 20 is represented by a maximum width of a cross section of one filament (the cross section perpendicular to an axial direction). When organic fiber 20 is a multifilament, the diameter of organic fiber 20 is represented by a maximum width of a cross section of the multifilament, that is, a maximum width of a cross section of an aggregate of a plurality of monofilaments (the cross section perpendicular to an axial direction).

It should be noted that wrapped yarn 1 may be a doubled-and-twisted yarn in which tungsten wire 10 and organic fiber 20 are twisted together. For example, the doubled-and-twisted yarn is manufactured by doubling and twisting tungsten wire 10 and organic fiber 20 (that is, performing a doubling and twisting process). At least one of tungsten wire 10 and organic fiber 20 may be a multifilament.

[Tungsten Wire]

Next, a configuration of tungsten wire 10 will be described.

Tungsten wire 10 is an alloy wire including an alloy of tungsten (W) and at least one type of metallic element other than tungsten (hereinafter, referred to as an alloying element). The content of tungsten contained in tungsten wire 10 is, for example, greater than or equal to 90 wt %. Here, the content is a proportion of a mass of the metallic element (for example, tungsten) with respect to a mass of tungsten wire 10. The content of tungsten may be greater than or equal to 95 wt %, may be greater than or equal to 99 wt %, or may be greater than or equal to 99.9 wt %.

Each of the at least one type of alloying element is a metallic element included in Group 7 or Group 8 in the periodic table. Specifically, the alloying element is rhenium (Re) in Group 7 or ruthenium (Ru) in Group 8. For example, tungsten wire 10 is an alloy wire including tungsten and rhenium (hereinafter, referred to as a rhenium-tungsten alloy wire). Alternatively, tungsten wire 10 is an alloy wire including tungsten and ruthenium (hereinafter, referred to as a ruthenium-tungsten alloy wire). It should be noted that tungsten wire 10 may be an alloy wire including tungsten and two or more types of alloying elements, such as an alloy wire including tungsten, rhenium, and ruthenium.

In the case of the rhenium-tungsten alloy wire, a content of rhenium is, for example, greater than or equal to 0.1 wt % and less than or equal to 10 wt %. The content of rhenium may be greater than or equal to 0.5 wt % and less than or equal to 9 wt % or may be greater than or equal to 3 wt % and less than or equal to 5 wt %. In the case of the ruthenium-tungsten alloy wire, a content of ruthenium is, for example, greater than or equal to 0.05 wt % and less than or equal to 0.3 wt %. The content of ruthenium may be greater than or equal to 0.1 wt % and less than or equal to 0.2 wt %.

The greater the content of rhenium and/or ruthenium, the more the elongation percentage and a tensile strength of tungsten wire 10 increases. However, a high tensile strength causes such a problem that the elongation percentage is unlikely to increase. Furthermore, the greater the content of rhenium and/or ruthenium, the more difficult it is to reduce the diameter of tungsten wire 10. In the present embodiment, a content of the alloying element and a processing step of reducing the diameter are engineered through diligent studies by the inventors of the present application, thereby providing tungsten wire 10 that is thin, has a high elongation percentage, and has a high tensile strength. A specific manufacturing method of tungsten wire 10 will be described later.

The diameter of tungsten wire 10 is, for example, less than or equal to 40 μm. The diameter of tungsten wire 10 may be less than or equal to 30 μm or may be less than or equal to 20 μm. For example, the diameter of tungsten wire 10 may be less than or equal to 18 μm, may be less than or equal to 15 μm, may be less than or equal to 12 μm, or may be less than or equal to 10 μm. The diameter of tungsten wire 10 may be as small as a processing limit (for example, 5 μm).

The elongation percentage of tungsten wire 10 according to the present embodiment is greater than or equal to 5%. Accordingly, in manufacturing and use of wrapped yarn 1 including tungsten wire 10, occurrence of breaking of tungsten wire 10 is suppressed. The elongation percentage of tungsten wire 10 may be greater than or equal to 7%, may be greater than or equal to 9%, may be greater than or equal to 11%, may be greater than or equal to 13%, or may be greater than or equal to 16%. The higher the elongation percentage, the more an effect of suppressing the occurrence of breaking of tungsten wire 10 is enhanced.

The tensile strength of tungsten wire 10 is, for example, greater than or equal to 1600 MPa (=N/mm$^2$) and less than or equal to 2400 MPa. Accordingly, in manufacturing and use of wrapped yarn 1 including tungsten wire 10, occurrence of breaking of tungsten wire 10 is suppressed. The tensile strength of tungsten wire 10 may be greater than or equal to 1700 MPa, may be greater than or equal to 1800 MPa, may be greater than or equal to 2000 MPa, or may be greater than or equal to 2100 MPa. The higher the tensile strength, the more an effect of suppressing the occurrence of breaking of tungsten wire 10 is enhanced.

[Manufacturing Method]

Figure 2:
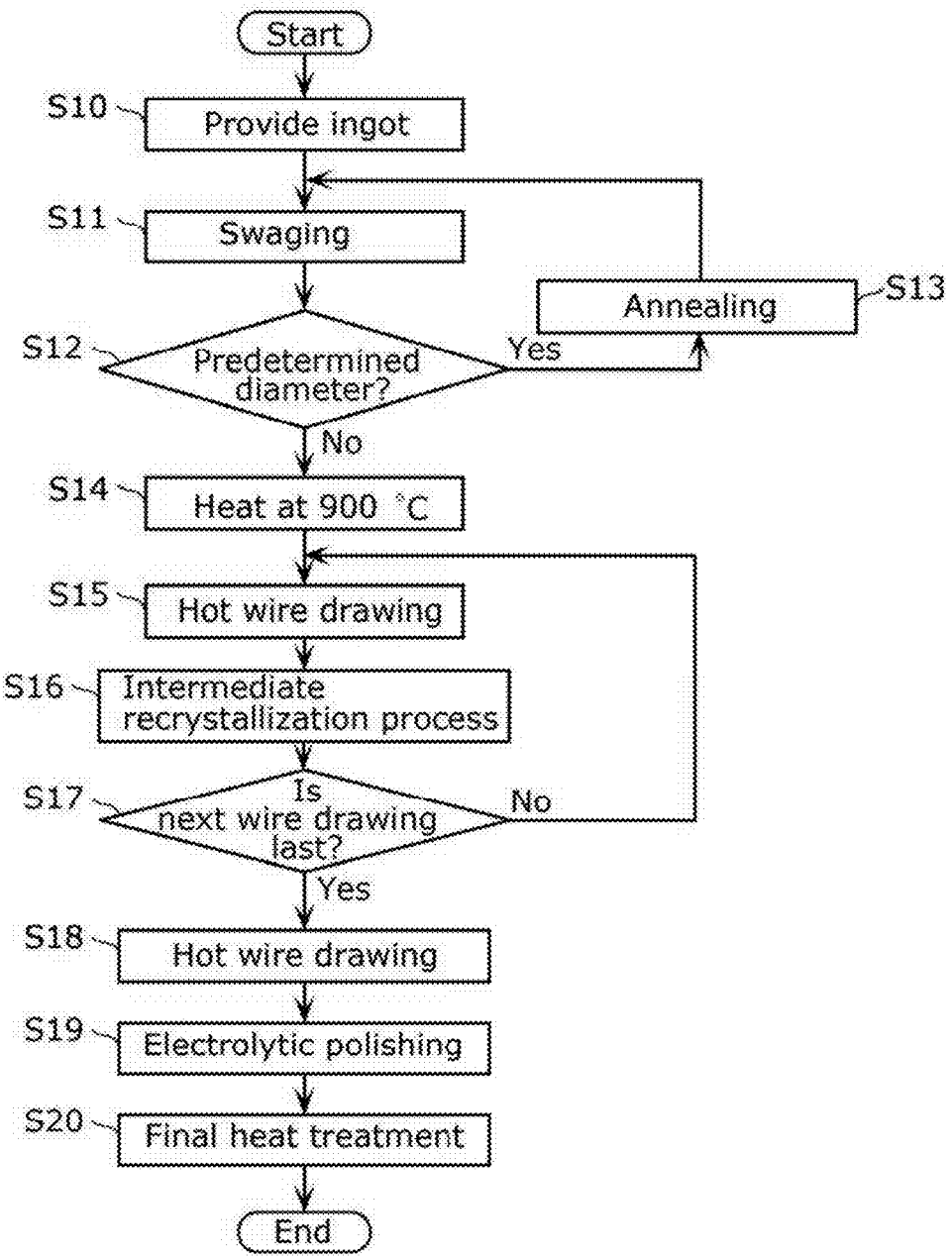
FIG. 2 is a flowchart illustrating an example of a manufacturing method of a tungsten wire included in the wrapped yarn according to the embodiment.

Subsequently, with reference to FIG. 2, a manufacturing method of tungsten wire 10 according to the present embodiment will be described. FIG. 2 is a flowchart illustrating an example of the manufacturing method of tungsten wire 10 according to the present embodiment.

As illustrated in FIG. 2, an ingot of a metal is first prepared (S10). Specifically, first, a mixture is prepared by mixing tungsten powder and powder including an alloying metal (for example, rhenium powder or ruthenium powder) in a predetermined ratio. An average particle diameter of the powder is within a range of greater than or equal to 3 μm and less than or equal to 4 μm. However, the average particle diameter is not limited to this. Pressing and sintering are performed on the prepared mixture to produce an ingot of the tungsten alloy. The ingot is, for example, a rod-shaped ingot having a cross section with a diameter of about 15 mm.

Next, a swaging process is performed on the ingot (S11). Specifically, the ingot is forged and compressed from around to be extended, thus being formed into a wire-shaped tungsten wire. A rolling process may be performed instead of the swaging process. The swaging process (S11) is repeatedly performed together with annealing (S13).

Specifically, as the swaging process is repeated, a diameter of the ingot is decreased in order of 13.6 mm, 10.6 mm, 8 mm, 6.5 mm, and 3.3 mm. When the diameter of the ingot is equal to each of these diameters (Yes in S12), the annealing is performed (S13). A temperature of the annealing is, for example, 2400° C. After the diameter is decreased to 3.3 mm, the ingot is subjected to the annealing and the swaging process, and thus the diameter becomes 3 mm.

Next, the tungsten wire subjected to the swaging process to have a diameter of 3 mm is heated at 900° C. (S14). Specifically, the tungsten wire is heated directly with a burner or the like. Heating the tungsten wire forms an oxide layer on a surface of the tungsten wire so that the tungsten wire does not break during processing in hot wire drawing that is subsequently performed.

Next, the hot wire drawing is performed (S15). Specifically, drawing of the tungsten wire, that is, wire drawing (reducing the diameter) of the tungsten wire is performed with one or more wire drawing dies while the tungsten wire is heated. A temperature of the heating is, for example, 1000° C. Note that the higher the temperature of the heating, the more the workability of the tungsten wire increases, and the wire drawing can be performed easily. The hot wire drawing is repeated while replacing one of the wire drawing dies with another. The reduction in area of the tungsten wire made by performing the wire drawing once with one wire drawing die is, for example, greater than or equal to 10% and less than or equal to 40%. In a step of the hot wire drawing, a lubricant including graphite dispersed in water may be used.

Next, an intermediate recrystallization process is performed on the tungsten wire subjected to the wire drawing (S16). Specifically, the tungsten wire is heated at a temperature greater than or equal to 1200° C. to recrystallize crystals included in the tungsten wire. Until the last time of a step of the wire drawing (No in S17), the hot wire drawing and the intermediate recrystallization process are repeated. The number of repetitions at this time (that is, the number of intermediate recrystallization processes) is, for example, greater than or equal to five and less than or equal to ten.

In the repetition of the hot wire drawing, a wire drawing die used in a certain wire drawing has a smaller bore diameter than a wire drawing die used in an immediately previous wire drawing. Furthermore, in the repetition of the hot wire drawing, the tungsten wire is heated at a temperature of the heating lower than a temperature of the heating in an immediately previous wire drawing. For example, a temperature of the heating in a wire drawing process immediately previous to a last wire drawing step is lower than temperatures of the heating in preceding wire drawing steps, for example, 400° C.

When the step of the wire drawing is the last time of the wire drawing (Yes in S17), the hot wire drawing is performed as the last wire drawing (S18). Accordingly, the tungsten wire having a diameter of less than about 40 μm is provided.

Next, electrolytic polishing is performed on the tungsten wire subjected to the wire drawing (S19). For example, the electrolytic polishing is driven by a potential difference made between a tungsten wire and a counter electrode that are immersed in an electrolyte solution such as aqueous sodium hydroxide. The electrolytic polishing enables fine adjustment of the diameter of the tungsten wire.

After the electrolytic polishing, final heat treatment is performed on the tungsten wire (S20). A temperature of the final heat treatment is, for example, greater than or equal to 1200° C. and less than or equal to 1700° C.

Through the above steps, tungsten wire 10 according to the present embodiment is manufactured. Immediately after being manufactured through the above manufacturing steps, tungsten wire 10 has a length of, for example, greater than or equal to 50 km, which enables industrial use of tungsten wire 10. Tungsten wire 10 is cut to an appropriate length in accordance with its usage and is used to manufacture wrapped yarn 1 or various fiber products. As described above, the present embodiment enables tungsten wire 10 to be industrially mass-produced and to be used mainly in fiber products.

It should be noted that the steps shown in the manufacturing method of tungsten wire 10 are performed in-line, for example. Specifically, a plurality of wire drawing dies used in step S15 and the like are disposed in a production line in descending order of bore diameter. In addition, a heating device such as a burner is disposed between every adjacent wire drawing dies. The heating device is disposed for the hot wire drawing and the intermediate recrystallization process. Furthermore, on a downstream side (post-processing side) of wire drawing dies used in step S15, a plurality of wire drawing dies used in step S18 are disposed in descending order of bore diameter, and on a downstream side of a wire drawing die having a smallest bore diameter, an electrolytic polishing device and a heating device for the final heat treatment are disposed. It should be noted that the steps may be performed individually.

WORKING EXAMPLES

Subsequently, working examples of tungsten wire 10 manufactured according to the manufacturing method described above and comparative examples will be described. Tungsten wires 10 according to Working Examples 1 to 15 and Comparative Examples 1 to 8 shown below were manufactured to differ in various parameters in the manufacturing method (specifically, diameter, additive type, amount added, final heat treatment temperature, and the number of intermediate recrystallization processes) as appropriate. Specifically, the parameters are as shown in Table 1 and Table 2 below.

TABLE 1

| Working Example No. | Diameter [μm] | Additive | Elongation percentage [%] | Tensile strength [MPa] | Amount added [wt %] | Final heat treatment temperature [° C.] | Number of intermediate recrystallization processes [times] |
|---|---|---|---|---|---|---|---|
| 1 | 11 | Re | 6.9 | 1810 | 5 | 1400 | 8 |
| 2 | | | 7.5 | 1760 | | 1500 | |
| 3 | 12 | | 5.5 | 1740 | 3 | 1550 | 10 |
| 4 | 18 | | 11.8 | 1790 | 5 | 1600 | 7 |
| 5 | 35 | | 7.9 | 1920 | 3 | | 6 |
| 6 | | | 11.7 | 1810 | | 1700 | |
| 7 | | | 5.0 | 2120 | 5 | 1300 | |
| 8 | | | 7.1 | 2030 | | 1400 | |
| 9 | | | 13.8 | 1790 | | 1600 | |
| 10 | | | 5.1 | 1960 | 3 | 1700 | 5 |
| 11 | | Ru | 5.6 | 2200 | 0.2 | 1200 | 6 |
| 12 | | Re | 11.3 | 1930 | 5 | 1500 | 5 |
| 13 | | | 16.0 | 1740 | | 1600 | |
| 14 | | | 6.0 | 2110 | 9 | | 7 |
| 15 | | | 11.9 | 2050 | | 1700 | |

TABLE 2

| Comparative Example No. | Diameter [μm] | Additive | Elongation percentage [%] | Tensile strength [MPa] | Amount added [wt %] | Final heat treatment temperature [° C.] | Number of intermediate recrystallization processes [times] |
|---|---|---|---|---|---|---|---|
| 1 | 35 | Re | 2.0 | 2400 | 5 | 1200 | 5 |
| 2 | | | 2.5 | 2190 | | 1400 | |
| 3 | | | 1.4 | 2010 | 3 | 1600 | 3 |
| 4 | | | 0.9 | 1620 | | 1700 | |
| 5 | | | 1.2 | 1850 | 5 | | |
| 6 | 18 | | 1.2 | 2030 | | 1500 | 4 |
| 7 | | | 1.6 | 1840 | | 1550 | |
| 8 | 12 | | 1.1 | 2160 | | 1500 | 5 |

Figure 3:
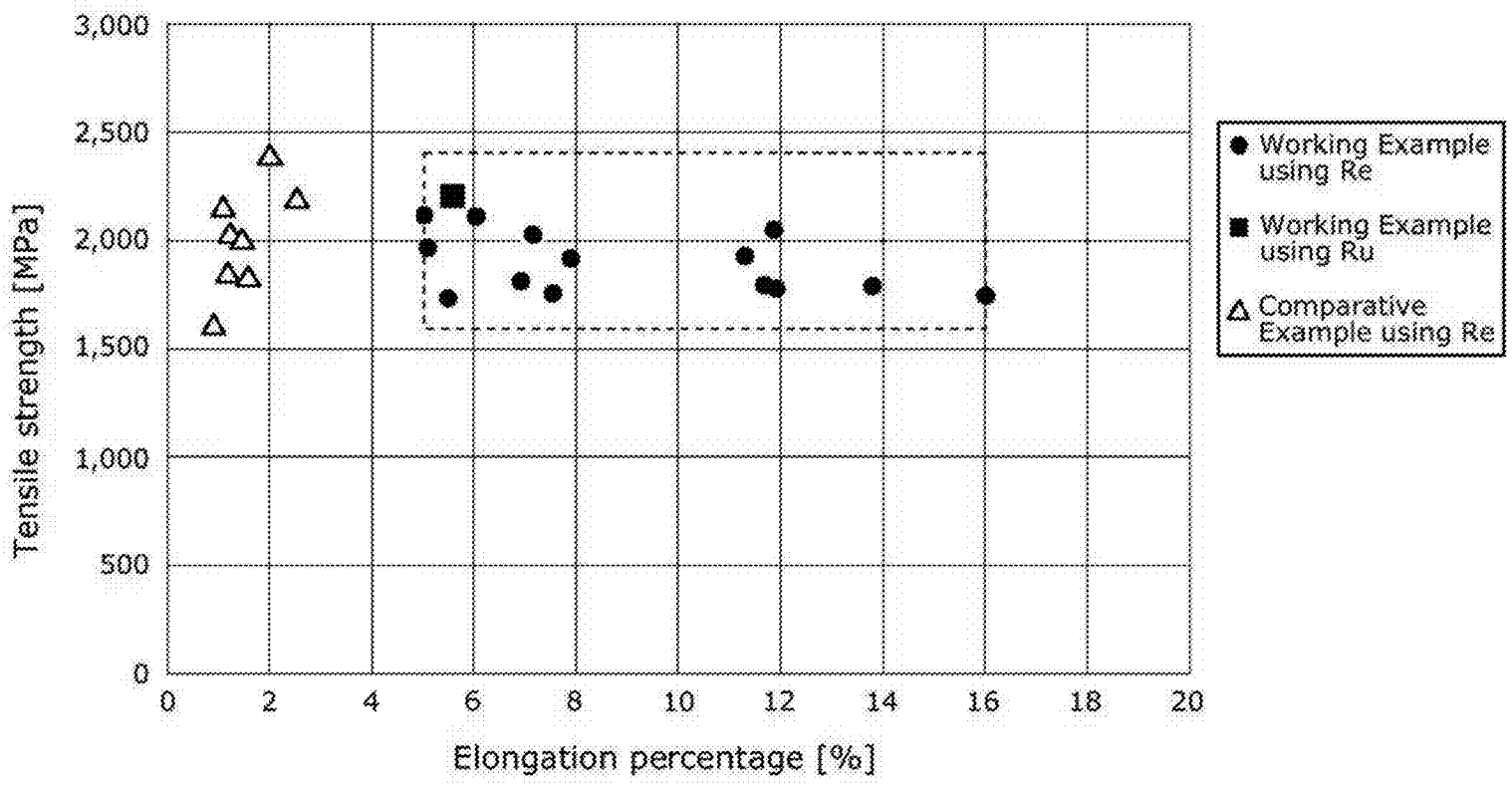
FIG. 3 is a scatter diagram illustrating a relationship between elongation percentages and tensile strengths of tungsten wires according to working examples and comparative examples.

FIG. 3 is a scatter diagram illustrating a relationship between elongation percentages and tensile strengths of tungsten wires 10 according to working examples and comparative examples. In FIG. 3, the horizontal axis represents elongation percentage [%] of tungsten wire 10 and the vertical axis represents tensile strength [MPa] of tungsten wire 10.

Tungsten wires 10 according to Working Examples 1 to 15 all had diameters less than 40 μm. Furthermore, as shown in FIG. 3, tungsten wires 10 according to working examples all had tensile strengths that were greater than or equal to 1600 MPa and less than or equal to 2400 MPa and all had elongation percentages that fell within a range of greater than or equal to 5% and less than or equal to 16%. It should be noted that, in FIG. 3, the ranges of the tensile strengths and the elongation percentages described above are drawn with broken lines. In contrast, tungsten wires 10 according to Comparative Examples 1 to 8 are located out of the ranges drawn with the broken lines in FIG. 3.

Results of studies about the parameters in the manufacturing method of tungsten wire 10 that are assumed as factors of differences between working examples and comparative examples will be described below.

<Additive>

First, types and amounts added (contents in tungsten wires 10) of alloying elements, which are additives, will be described. Table 1 shows that the elongation percentage tends to increase with an increase in the amount added of the alloying element.

Furthermore, in Table 1, Working Example 5 and Working Example 9 were the same in the parameters except for an amount added of Re: diameter (35 μm), additive (Re), final heat treatment number temperature (1600° C.), and the of intermediate recrystallization processes (6 times). Specifically, Working Example 5 includes 3 wt % Re and Working Example 9 includes 5 wt % Re, as shown in Table 1. Comparison between Working Example 5 and Working Example 9 shows that Working Example 9 with a larger amount added of Re had a higher elongation percentage and a lower tensile strength compared with Working Example 5.

From this, increasing the amount added of the alloying element can lead to a higher elongation percentage while keeping the tensile strength greater than or equal to 1600 MPa. Conversely, reducing the amount added of the alloying element can lead to a higher tensile strength while keeping the elongation percentage greater than or equal to 5%.

It should be noted that using Ru as the additive, as in Working Example 11, can keep both a high elongation percentage and a high tensile strength even when an amount added of Ru is approximately one order of magnitude smaller than an amount added of Re.

<Final Heat Treatment Temperature>

Next, the final heat treatment temperature will be described. Table 1 shows that the elongation percentage tends to increase with an increase in the final heat treatment temperature.

Furthermore, in Table 1, Working Example 1 and Working Example 2 were the same in the parameters except for the final heat treatment temperature: diameter (11 μm), additive (Re), amount added (5 wt %), and the number of intermediate recrystallization processes (8 times). Comparison between Working Example 1 and Working Example 2 shows that Working Example 2 with a higher final heat treatment temperature has a higher elongation percentage and a lower tensile strength compared with Working Example 1. Specifically, Working Example 1 has a final heat treatment temperature of 1400° C. and Working Example 2 has a final heat treatment temperature of 1500° C., as shown in Table 1. Working Example 5 and Working Example 6 were the same in the parameters except for the final heat treatment temperature and showed the same tendency. Specifically, Working Example 5 has a final heat treatment temperature of 1600° C. and Working Example 6 has a final heat treatment temperature of 1700° C. Working Examples 7 to 9, Working Examples 12 and 13, and Working Examples 14 and 15 were each the same in the parameters except for the final heat treatment temperature, and showed the same tendency. Specifically, Working Example 7 has a final heat treatment temperature of 1300° C., Working Example 8 has a final heat treatment temperature of 1400° C., and Working Example 9 has a final heat treatment temperature of 1600° C. Specifically, Working Example 12 has a final heat treatment temperature of 1500° C. and Working Example 13 has a final heat treatment temperature of 1600° C. Specifically, Working Example 14 has a final heat treatment temperature of 1600° C. and Working Example 15 has a final heat treatment temperature of 1700° C. The same tendency is also shown in both a case of a diameter of 11 μm (Working Examples 1 and 2) and a case of a diameter of 35 μm (Working Example 5, etc.).

From these, increasing the final heat treatment temperature can lead to a higher elongation percentage while keeping the tensile strength greater than or equal to 1600 MPa irrespective of a size of the diameter of tungsten wire 10. Conversely, decreasing the final heat treatment temperature can lead to a higher tensile strength while keeping the elongation percentage greater than or equal to 5% irrespective of the size of the diameter of tungsten wire 10.

It should be noted that Comparative Examples 1 and 2 in Table 2 were the same as Working Examples 12 and 13 in Table 1 in the parameters except for the final heat treatment temperature. However, Comparative Examples 1 and 2, in which their final heat treatment temperatures were less than or equal to 1400° C., resulted in elongation percentages that were less than 5%. Specifically, Comparative Example 1 has a final heat treatment temperature of 1200° C. and Comparative Example 2 has a final heat treatment temperature of 1400° C., whereas Working Example 12 has a final heat treatment temperature of 1500° C. and Working Example 13 has a final heat treatment temperature of 1600° C., as shown in Tables 1 and 2. From this, at least when the diameter is 35 μm, 5 wt % of $R^e$ is added, and the intermediate recrystallization process is performed 5 times, it is deemed that the elongation percentage can be brought to be greater than or equal to 5% by performing the manufacture with the final heat treatment temperature being a temperature higher than 1400° C., preferably a temperature greater than or equal to 1500° C.

It should be noted that using Ru as the additive, as in Working Example 11, can keep both a high elongation percentage and a high tensile strength even when the final heat treatment temperature is 1200° C.

<Number of Intermediate Recrystallization Processes>

Next, the number of intermediate recrystallization processes will be described. Table 1 shows that the elongation percentage tends to increase with an increase in the number of intermediate recrystallization processes. Specifically, when the number of intermediate recrystallization processes is greater than or equal to 5, the elongation percentage can be brought to be greater than or equal to 5%.

Furthermore, Working Example 6 and Working Example 10 in Table 1 were the same in the parameters except for the number of intermediate recrystallization processes: diameter (35 μm), additive (Re), amount added (3 wt %), and final heat treatment temperature (1700° C.). Comparison between Working Example 6 and Working Example 10 shows that Working Example 6 with a larger number of intermediate recrystallization processes had a higher elongation percentage and a lower tensile strength compared with Working Example 10. Specifically, Working Example 6 includes six intermediate recrystallization processes, whereas Working Example 10 includes five intermediate recrystallization processes, as shown in Table 1. Conversely, reducing the number of intermediate recrystallization processes can lead to a higher tensile strength while keeping the elongation percentage greater than or equal to 5%.

It should be noted that Comparative Example 4 in Table 2 was the same as Working Examples 6 and 10 in Table 1 in the parameters except for the number of intermediate recrystallization processes. However, in this case, elongation percentages and tensile strengths of Working Examples 6 and 10, in which their numbers of intermediate recrystallization processes were greater than or equal to five, were both higher compared with that of Comparative Example 4, in which its number of intermediate recrystallization processes is three. Specifically, Comparative Example 4 includes three intermediate recrystallization processes, whereas Working Example 6 includes six intermediate recrystallization processes and Working Example 10 includes five intermediate recrystallization processes, as shown in Tables 1 and 2. This point shows that the number of intermediate recrystallization processes being less than or equal to 3 fails to bring the elongation percentage to be greater than or equal to 5%.

Furthermore, Table 1 shows that different diameters require different numbers of intermediate recrystallization processes. Specifically, when the diameter is within a range of greater than or equal to 11 μm and less than or equal to 18 μm, the elongation percentage of tungsten wire 10 was brought to be greater than or equal to 5% when the number of intermediate recrystallization processes is greater than or equal to 8. In contrast, when the diameter is 35 μm, the elongation percentage of tungsten wire 10 was brought to be greater than or equal to 5% when the number of intermediate recrystallization processes is greater than or equal to 5. From this point, it can be determined that obtaining tungsten wire 10 having a smaller diameter only requires a larger number of intermediate recrystallizations than when obtaining tungsten wire 10 having a larger diameter.

It should be noted that the recrystallization process refers to rearrangement of crystals by heat treatment. The recrystallization process accelerates dispersion of a dissolved element such as Re or Ru, thus contributing to an increase in the elongation percentage when the diameter of tungsten wire 10 is reduced. As described above, a dispersity of the alloying element (Re or Ru) in tungsten wire 10 is improved by heating tungsten wire 10 in a form of the recrystallization process in the manufacturing steps. Accordingly, uneven distribution of the alloying element can be suppressed, and thus enhancement in tensile strength and increase in elongation percentage in a thin tungsten wire 10 can both be achieved.

The description is here given of the case of tungsten wire 10 having a diameter of less than 40 μm and a tensile strength of less than or equal to 2400 MPa by way of example. However, it should be noted that the diameter and the tensile strength are not limited to these. The diameter of tungsten wire 10 may be greater than or equal to 40 μm. Furthermore, the tensile strength of tungsten wire 10 may be greater than or equal to 2400 MPa.

[Relationship Between Elongation of Organic Fiber And Elongation of Tungsten Wire]

Subsequently, a relationship between elongation of organic fiber 20 and elongation of tungsten wire 10 will be described.

In general, organic fiber 20 has a higher elongation percentage compared with tungsten wire 10. In short, organic fiber 20 is easy to elongate, and tungsten wire 10 is difficult to elongate. Thus, if tungsten wire 10 fails to be elongated along with the elongation of organic fiber 20 caused by external stress such as tensile, bending, or torsional stress, tungsten wire 10 may partly break.

Figure 4:
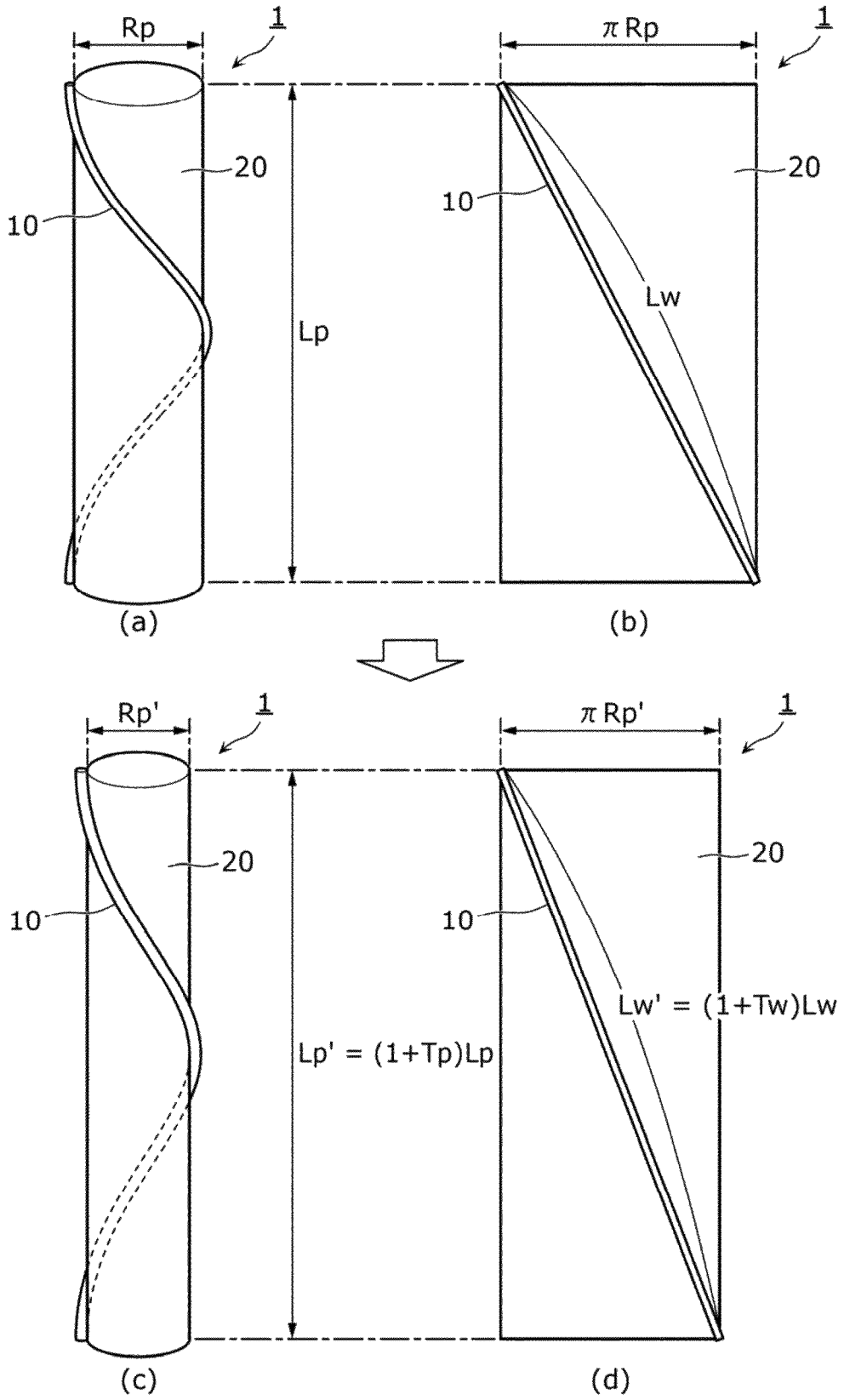
FIG. 4 is a schematic diagram illustrating the states of a wrapped yarn according to the embodiment before and after elongation.

FIG. 4 is a schematic diagram of wrapped yarn 1 according to the present embodiment before and after elongation. In FIG. 4, (a) and (b) illustrate a perspective view and a development view of a lateral surface of wrapped yarn 1 before elongation, respectively, and (c) and (d) illustrate a perspective view and a development view of the lateral surface of wrapped yarn 1 after elongation, respectively.

In (a) in FIG. 4, the diameter of organic fiber 20 is denoted as Rp. Furthermore, a winding pitch of tungsten wire 10 is denoted as Lp. As illustrated in (c) in FIG. 4, when organic fiber 20 is elongated, the diameter of organic fiber 20 becomes Rp'. The elongation of organic fiber 20 increases a length of organic fiber 20 but does not change its volume. Thus, diameter Rp' of organic fiber 20 after elongation inevitably becomes smaller than diameter Rp of organic fiber 20 before elongation.

When tungsten wire 10 is elongated along with the elongation of organic fiber 20, the winding pitch of tungsten wire 10 after elongation becomes Lp'. Winding pitch Lp' of tungsten wire 10 after elongation is larger than winding pitch Lp of tungsten wire 10 before elongation.

As illustrated in (b) in FIG. 4, when a length of tungsten wire 10 before elongation is denoted as Lw, Lw is expressed by Equation (1) below. Note that x is the ratio of a circle's circumference to its diameter.

[Math. 1]

$$L_w = \sqrt{L_p^2 + \pi^2 R_p^2} \tag{1}$$

As illustrated in (d) in FIG. 4, when the length of tungsten wire 10 after elongation is denoted as Lw', Lw' is expressed by Equation (2) below.

[Math. 2]

$$L'_w = \sqrt{L'^2_p + \pi^2 R'^2_p} \tag{2}$$

When the elongation percentage of organic fiber 20 is denoted as Tp, and the elongation percentage of tungsten wire 10 is denoted as Tw, Tp and Tw are expressed by Equations (3) and (4) below, respectively.

[Math. 3]

$$T_p = \frac{L'_p}{L_p} - 1 \tag{3}$$

$$T_w = \frac{L'_w}{L_w} - 1 \tag{4}$$

By transforming Equations (1) to (4), Tw is expressed by Equation (5) below using Rp, Lp, and Tp.

[Math. 4]

$$T_w = \sqrt{\frac{\left(\frac{L_p}{R_p}\right)^2 (1 + T_p)^3 + \pi^2}{\left(\frac{L_p}{R_p}\right)^2 + \pi^2} \cdot \frac{1}{1 + T_p}} - 1 \tag{5}$$

A value of Tw shown by Equation (5) above is a value of elongation percentage Tw that is necessary for tungsten wire 10 to be elongated along with, without breaking, an elongation of organic fiber 20 with elongation percentage Tp. Therefore, elongation percentage Tw of tungsten wire 10 being greater than or equal to the right-hand side of Equation (5) above means that tungsten wire 10 can be elongated along with the elongation of organic fiber 20.

Here, with reference to FIG. 5, a specific example of elongation percentage Tp of organic fiber 20 will be described.

FIG. 5 is a table showing maximum values of elongation percentages Tp of types of fibers that can be used as organic fiber 20. As shown in FIG. 5, the maximum value of elongation percentage Tp of organic fiber 20 significantly varies among materials. A typical material as organic fiber 20 having a lowest elongation percentage Tp is hemp (flax). Its maximum value of elongation percentage Tp is 1.5% to 2.3%. Furthermore, polypropylene is a material that is relatively easy to elongate. Its maximum value of elongation percentage Tp is 25% to 60%. The other materials generally have maximum values of elongation percentage Tp within a range of 10% to 30%.

The maximum values of elongation percentage Tp shown in FIG. 5 are approximate values in a standard environment. For example, organic fiber 20 becomes easier to elongate in a humid environment, and its maximum value of elongation percentage Tp also becomes higher. Furthermore, in the case of a multifilament, its maximum value of elongation percentage Tp also generally becomes high. With consideration of such variations in elongation percentage Tp among environments and the like, it is estimated that the maximum values of elongation percentage Tp of organic fiber 20 can take about 1.5 to 2.0 times the values shown in FIG. 5.

Next, with reference to FIG. 6, a specific value of Lp/Rp will be described.

FIG. 6 is a table showing examples of Lp/Rp of wrapped yarn 1 in a case where tungsten wire 10 is wound around each of a plurality of organic fibers 20 having different diameters with a predetermined number of turns. FIG. 6 shows, as four examples of the covering process, cases where the numbers of turns per inch are 21 and 18 and cases where the numbers of turns per meter are 100 and 1000. Furthermore, as examples of organic fiber 20, three organic fibers 20 having diameters Rp of 0.3 mm, 0.8 mm, and 1.2 mm are shown.

Values of Lp/Rp calculated from combinations of these fall within a range of greater than or equal to 0.83 and less than or equal to 33.33. Furthermore, typical values of Lp/Rp fall within the range of three to five.

In view of the above, it can be estimated that elongation percentage Tp of organic fiber 20 is about 100% at most (that is, elongated to twice its original length), and that the value of Lp/Rp of organic fiber 20 is about 100 at most. Hereinafter, results of calculating elongation percentage Tw of tungsten wire 10 with respect to elongation percentage Tp of organic fiber 20 using Equation (5) above for each of ratios of $R^p$ and Lp (Lp/Rp) will be shown in FIG. 7 and FIG. 8.

FIG. 7 and FIG. 8 are tables each showing elongation percentage Tw required for tungsten wire 10 at elongation percentages Tp of organic fiber 20 within a predetermined range. In FIG. 7 and FIG. 8, values of Lp/Rp are arranged in rows, values of Tp are arranged in columns, and values of Tw are written in cells at intersections of rows and columns. FIG. 7 shows the values of Tp in increments of 2% within the range from 0% to 40%, and FIG. 8 shows the values of Tp in increments of 5% within the range from 0% to 100%. In both FIG. 7 and FIG. 8, eight values of Lp/Rp: 1, 2, 2.5, 3, 5, 10, 50, and 100 are shown. A smaller value of Lp/Rp indicates that tungsten wire 10 is wound with a smaller pitch, and a larger value of Lp/Rp indicates that tungsten wire 10 is wound with a larger pitch.

The manufacturing method mentioned above enables tungsten wire 10 according to the present embodiment to yield elongation percentage Tw being greater than or equal to 5%. In FIG. 7 and FIG. 8, diagonal hatching indicates ranges within which tungsten wire 10 can be elongated along with the elongation of organic fiber 20 without breaking as long as elongation percentage Tw of tungsten wire 10 is 5% (that is, ranges where Tw calculated from Equation (5) are less than or equal to 5%).

FIG. 7 and FIG. 8 show that elongation percentage Tp of organic fiber 20 being less than or equal to 5% enables tungsten wire 10 to be elongated along with the elongation of organic fiber 20 without breaking irrespective of the value of Lp/Rp. As shown in FIG. 5, an elongation percentage of hemp, which is a material having a lowest elongation percentage as organic fiber 20, is 4.6 (=2.3× 2) % at most even when it is assumed that the elongation percentage can take a value twice its original value with consideration given to dependence on the environments and the like. That is, it is found that using hemp as organic fiber 20 enables tungsten wire 10 wound with any pitch to be elongated along with the elongation of organic fiber 20 without breaking.

Furthermore, as shown in FIG. 8, in a case where Lp/Rp is 2, tungsten wire 10 can be elongated along with the elongation of organic fiber 20 when elongation percentage Tp of organic fiber 20 is up to 45%. Thus, referring to FIG. 5, it is found that Lp/Rp being 2 accommodates elongation of many organic fibers including cotton, silk, rayon, polyester, and the like, in addition to hemp. As shown in FIG. 7, in a case where Lp/Rp is 2.5, tungsten wire 10 can be elongated along with the elongation of organic fiber 20 when elongation percentage Tp of organic fiber 20 is up to 26%. Thus, referring to FIG. 5, it is found that Lp/Rp being 2.5 accommodates elongation of cotton, in addition to hemp. An increase in Lp/Rp narrows the range of elongation percentage Tp of organic fiber 20 within which tungsten wire 10 can be elongated along with the elongation of organic fiber 20, but can accommodate more types of organic fibers 20 in some use environment.

Furthermore, tungsten wire 10 according to Working Example 13 mentioned above yields elongation percentage Tw being 16%. In FIG. 7 and FIG. 8, dotted shading indicates ranges within which tungsten wire 10 can be elongated along with the elongation of organic fiber 20 without breaking as long as elongation percentage Tw of tungsten wire 10 is 16% (that is, ranges where Tw calculated from Equation (5) are less than or equal to 16% (the diagonal hatching for the ranges of less than or equal to 5%)).

FIG. 7 shows that elongation percentage Tp of organic fiber 20 being less than or equal to 16% enables tungsten wire 10 to be elongated along with the elongation of organic fiber 20 without breaking irrespective of the value of Lp/Rp. Thus, tungsten wire 10 can be elongated along with elongation of more types of organic fibers 20 without breaking.

As shown in FIG. 5, there are not many organic fibers 20 that yield elongation percentages exceeding 50%. As shown in FIG. 8, in the case where Lp/Rp is 2, tungsten wire 10 can be elongated along with the elongation of organic fiber 20 when elongation percentage Tp of organic fiber 20 is up to 80%. Furthermore, in the case where Lp/Rp is 2.5, tungsten wire 10 can be elongated along with the elongation of organic fiber 20 when elongation percentage Tp of organic fiber 20 is up to 55%. That is, it is found that tungsten wire 10 having elongation percentage Tw being 16% can accommodate almost all of the types of organic fibers 20 shown in FIG. 5.

An increase in Lp/Rp narrows the range of elongation percentage Tp of organic fiber 20 within which tungsten wire 10 can be elongated along with the elongation of organic fiber 20, but can accommodate more types of organic fibers 20 in some use environment. As shown in FIG. 7 and FIG. 8, tungsten wire 10 having an elongation percentage of 16% can accommodate elongation percentages Tp of organic fibers 20 about three times elongation percentages Tp of organic fibers 20 accommodated by tungsten wire 10 having an elongation percentage of 5%.

An increase in Lp/Rp enables shortening of a length of tungsten wire 10 used for wrapped yarn 1. Thus, a consumption of tungsten wire 10 can be reduced, which realizes reduction in weight, cost, and the like of wrapped yarn 1.

[Fiber Product Including Wrapped Yarn]

Subsequently, a specific example of a fiber product including wrapped yarn 1 illustrated in FIG. 1 will be described.

Figure 9:
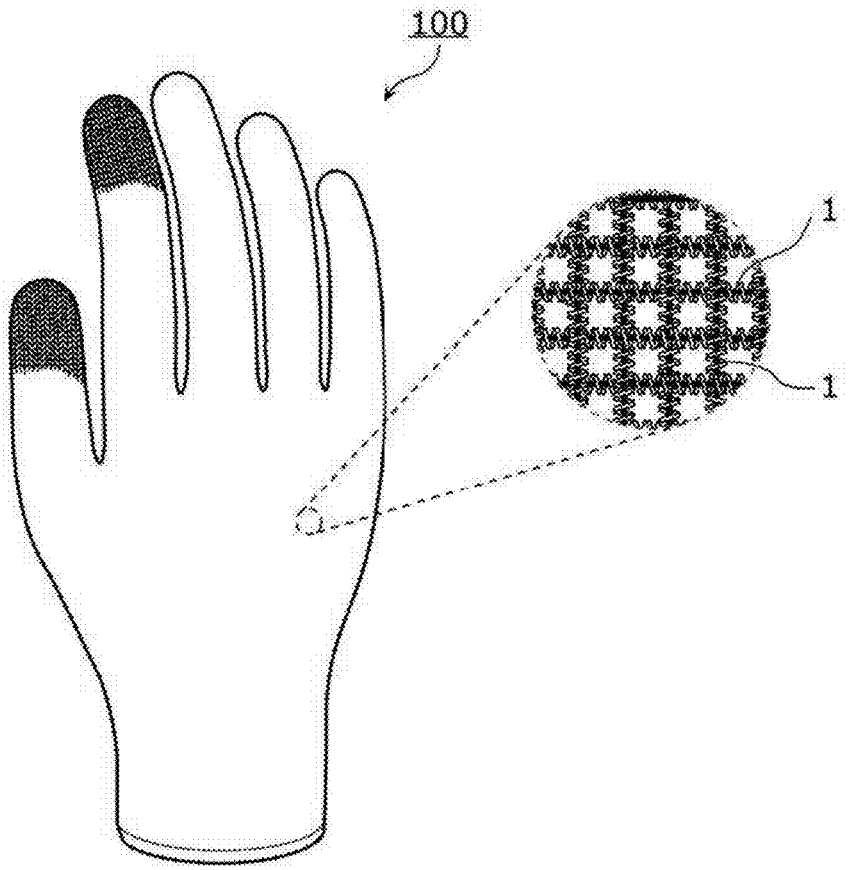
FIG. 9 is a schematic diagram of a fiber product including the wrapped yarn according to the embodiment.

The fiber product is one selected from a group containing a woven fabric, a knitted fabric, a braided fabric, a wrapped yarn, and a sewing-machine thread. With reference to FIG. 9, a glove including wrapped yarn 1 illustrated in FIG. 1 will be described below as an example of the fiber product.

FIG. 9 is a schematic diagram of fiber product 100 including wrapped yarn 1 according to an embodiment. As illustrated in FIG. 9, fiber product 100 is, for example, a glove. It should be noted that, although FIG. 9 schematically illustrates weaves in only tips of a thumb and a first finger, fiber product 100 is entirely woven.

Fiber product 100 is, for example, a work glove and includes a palm part and five finger parts. Fiber product 100 is manufactured by a weaving process using wrapped yarn 1 as warp yarn and weft yarn. A weave pattern of fiber product 100 is, for example, a twill weave (specifically, "Yotsuaya" having a 2/2 twill pattern). Specifically, as illustrated in FIG. 9, fiber product 100 is formed by causing a plurality of wrapped yarns 1 constituting the warp yarn to intersect with a plurality of wrapped yarns 1 constituting the weft yarn in such a manner that pairs of warp yarns and pairs of weft yarns alternatingly pass over and under each other.

It should be noted that the weave pattern of fiber product 100 is not limited to this, the weave pattern may be another type of twill weave such as "Mitsuaya" (2/1 or 1/2 twill) or "Yotsuaya" having a 3/1 twill pattern. Alternatively, the weave pattern of fiber product 100 may be plain weave or satin weave. Furthermore, fiber product 100 may be manufactured by performing a knitting process such as stockinette stitch with a predetermined gauge using wrapped yarn 1 as a knitting yarn.

Fiber product 100 illustrated in FIG. 9 can be used in, for example, cutting-resistant applications or vital sensing. For example, fiber product 100 can sense, as an example of a vital sign, a body temperature or a pulse of a wearer. Specifically, tungsten wire 10 included in fiber product 100 functions as terminals for sensing the vital sign. That is, tungsten wire 10 can detect a weak current generated by the wearer.

Alternatively, fiber product 100 may separately include terminals for sensing a vital sign. In this case, tungsten wire 10 may function as wiring that electrically connects the terminals and a signal processing circuit.

Alternatively, fiber product 100 may be used for generating heat. Specifically, heat can be generated by causing current to flow through tungsten wire 10 included in fiber product 100.

The fiber product may be clothing including clothes, headgear such as a hat, footgear such as socks or Japanese socks, and the like, in addition to gloves. Alternatively, the fiber product may be a towel, a hand towel, a handkerchief, a blanket, a sheet, or the like.

It should be noted that the fiber product need not include wrapped yarn 1 and may be formed using tungsten wire 10 and organic fiber 20 in combination. Specifically, the fiber product may be a nonwoven fabric manufactured by a nonwoven process using tungsten wire 10 and organic fiber 20 as thread materials. Alternatively, the fiber product may be wrapped yarns 1 collected like a cotton pellet. Alternatively, the fiber product may be a woven fabric manufactured using an organic fiber or a fiber fabric such as a knitted fabric or a braided fabric into which tungsten wire 10 is sewn (embroidery or sewing) afterward.

[Bendability of Tungsten Wire]

Subsequently, with reference to FIG. 10, a bendability of tungsten wire 10 will be described.

As illustrated in FIG. 1, tungsten wire 10 is wound around organic fibers 20 and is thus required to be capable of withstanding a bending having a curvature greater than or equal to a predetermined curvature. Furthermore, tungsten wire 10 is required to be capable of withstanding a bending having the curvature greater than or equal to the predetermined curvature so as to withstand various processes such as the weaving process and the knitting process, as with fiber product 100 illustrated in FIG. 9. Hence, the inventors of the present application conducted a coiling test to check the bendability of tungsten wire 10. Details and results of the coiling test will be described below.

Figure 10:
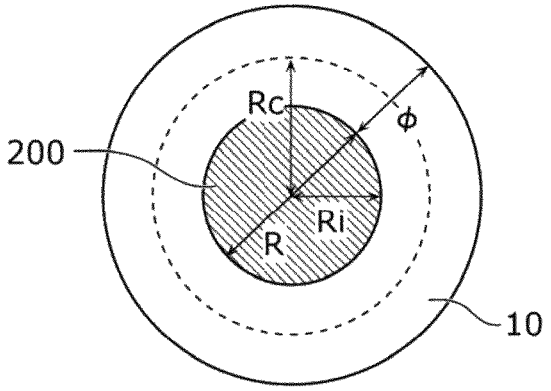
FIG. 10 is a diagram illustrating an overview of a coiling test on a tungsten wire according to the embodiment.

FIG. 10 is a diagram illustrating an overview of the coiling test on tungsten wire 10 according to an embodiment. In the coiling test, tungsten wire 10 was wound around core material 200 that is rod-shaped, has a circular cross-sectional shape, and is uniform in diameter, and whether a fracture or a surface delamination of tungsten wire 10 occurs was checked. Diameter R of a cross section of core material 200 and diameter ¢ of tungsten wire 10 used in the coiling test are determined in accordance with, for example, specifications of a fiber product manufactured using tungsten wire 10 and organic fiber 20.

Figure 11:
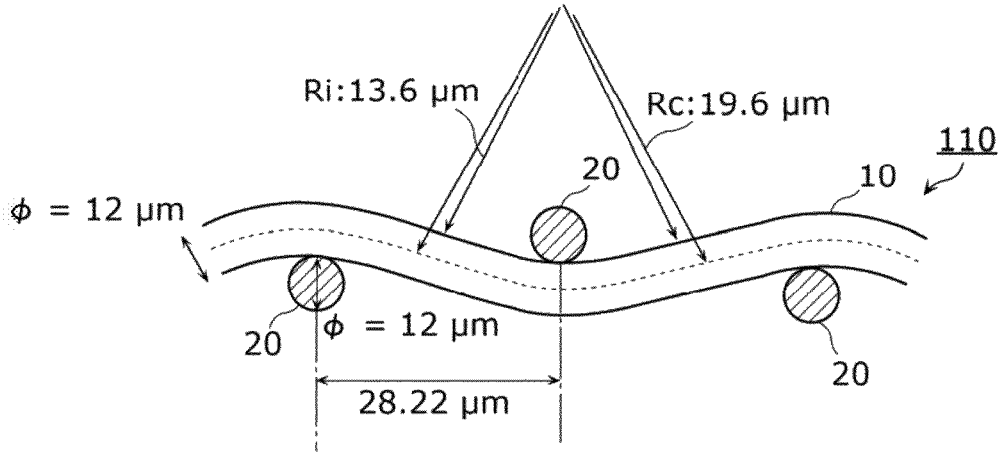
FIG. 11 is a cross-sectional view illustrating a metal mesh that is woven using the tungsten wire according to the embodiment and an organic fiber.

FIG. 11 is a cross-sectional view illustrating fiber product (metal mesh) 110 that is woven using tungsten wire 10 according to the present embodiment and organic fiber 20. Fiber product 110 is a metal mesh that is woven using tungsten wire 10 and organic fiber 20 as warp yarn and weft yarn, respectively. Here, a case where, as an example of fiber product 110, a metal mesh of 900 mesh count is manufactured using tungsten wire 10 having a diameter of 12 μm and organic fiber 20 is assumed. It should be noted that the mesh (mesh count) here means the number of threads that are present within 25.4 mm (1 inch). In this case, a pitch, which is a distance between two adjacent tungsten wires 10, is 28.2 μm (=25.4 mm/900). A case where the distance between two adjacent tungsten wires 10 is the same as a distance between two adjacent organic fibers 20 is assumed.

In this case, as illustrated in FIG. 11, radius of curvature Rc of tungsten wire 10 is 19.6 μm. It should be noted that radius of curvature Rc is defined based on a central axis of tungsten wire 10 (a broken line in the figure). Furthermore, inner radius of curvature Ri of tungsten wire 10 is 13.6 μm. Inner radius of curvature Ri is defined based on an inner surface of a bend of tungsten wire 10. That is, when neither fracturing nor surface delamination occurs in tungsten wire 10 in a state where radius of curvature Rc is less than or equal to 19.6 μm and inner radius of curvature Ri is less than or equal to 13.6 μm, tungsten wire 10 can be used for the warp yarn and the weft yarn of fiber product 110.

The coiling test was conducted under conditions that exceeded limits for weaving the metal mesh. When neither fracturing (breakage) nor surface delamination occurred in tungsten wire 10 as a result of the coiling test conducted under the conditions exceeding the limits for the weaving, it is possible to stably manufacture fiber product (metal mesh) 110 using tungsten wire 10 used in the test.

For example, a condition in which tungsten wires 10 having a diameter of 12 μm come into contact with each other is a case of 1222 mesh count. That is, it is not possible to manufacture a metal mesh having a mesh count greater than or equal to 1222 mesh count. As a condition for the coiling test, fiber product 110 of 1324 mesh count including 12 μm tungsten wire 10 is assumed.

It should be noted that breaking of tungsten wire 10 is caused by strain in the material constituting tungsten wire 10, and thus tungsten wire 10 of a different diameter can be used for study. For example, in terms of 35 μm tungsten wire 10, the condition of 12 μm 1324 mesh converts to 454 mesh (=1324 mesh×12 μm/35 μm). Under this condition, radius of curvature Rc is 31 μm, and inner radius of curvature Ri is 13.5 μm.

In the coiling test, the inventors of the present application used core material 200 having diameter R=27 μm and tungsten wire 10 having diameter $\phi$=35 μm. Tungsten wire 10 wound around core material 200 has inner radius of curvature Ri being 13.5 μm (=R/2) and radius of curvature Rc being 31.0 μm (=Ri+$\phi$/2). Therefore, when neither fracturing nor surface delamination occurred in the coiling test under this condition, this means that it is possible to manufacture fiber product (metal mesh) 110 of 900 mesh using 12-μm tungsten wire 10.

Results of the coiling test conducted on Comparative Examples 9 and 10, and Working Example 16 are shown in Table 3 below. It should be noted that, in all of Comparative Working Examples 9 and 10, and Working Example 16, their diameters were 35 μm, their alloying elements being the additives were Re, and their amounts added were 5 wt %. Furthermore, their numbers of intermediate recrystallization processes were all 6.

TABLE 3

| No. | Elongation percentage [%] | Tensile strength [MPa] | Final heat treatment temperature [° C.] | Fracturing | Surface delamination |
|---|---|---|---|---|---|
| Comparative Example 9 | 3 | 2160 | 1200 | Fractured | — |
| Comparative Example 10 | 4 | 2130 | 1300 | Not fractured | Occurred slightly |
| Working Example 16 | 5 | 2100 | 1400 | Fractured | Not observed |

Figure 12A:
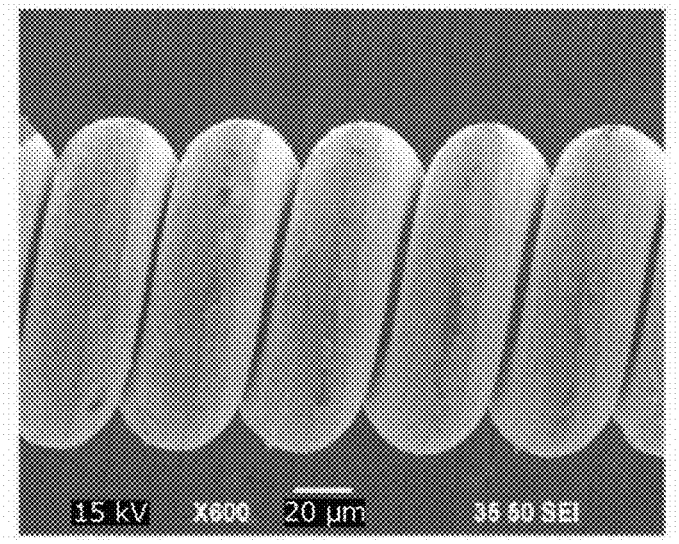
FIG. 12A is a diagram illustrating an external appearance of a tungsten wire according to Working Example 16 subjected to the coiling test.
Figure 12B:
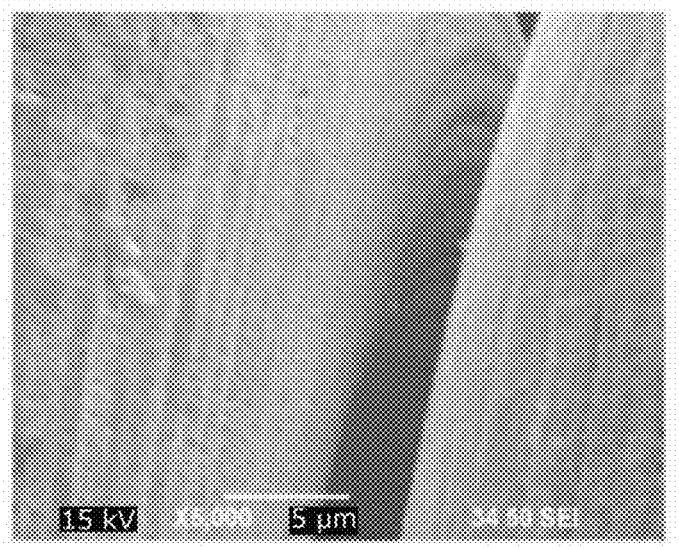
FIG. 12B is a diagram illustrating a part of FIG. 12A under magnification.

FIG. 12A is a diagram illustrating an external appearance of a tungsten wire according to Working Example 16 subjected to the coiling test. FIG. 12B is a diagram illustrating a part of FIG. 12A under magnification. As illustrated in FIG. 12A and FIG. 12B, in Working Example 16, neither fracturing nor surface delamination occurred in the tungsten wire.

Figure 13A:
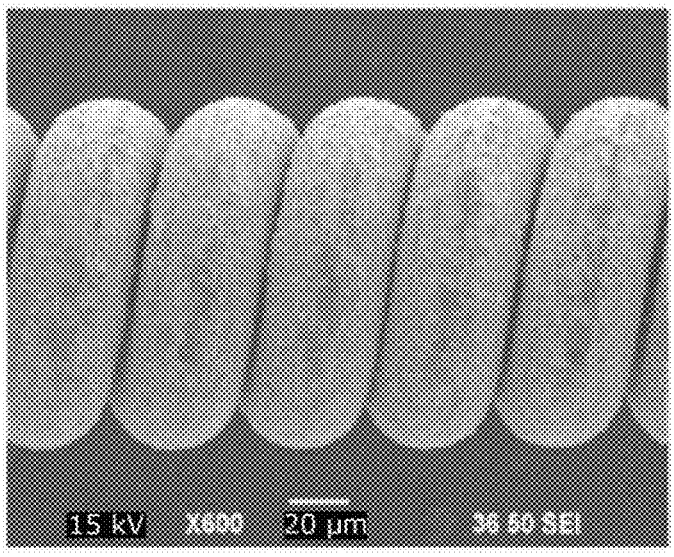
FIG. 13A is a diagram illustrating an external appearance of a tungsten wire according to Comparative Example 10 subjected to the coiling test.
Figure 13B:
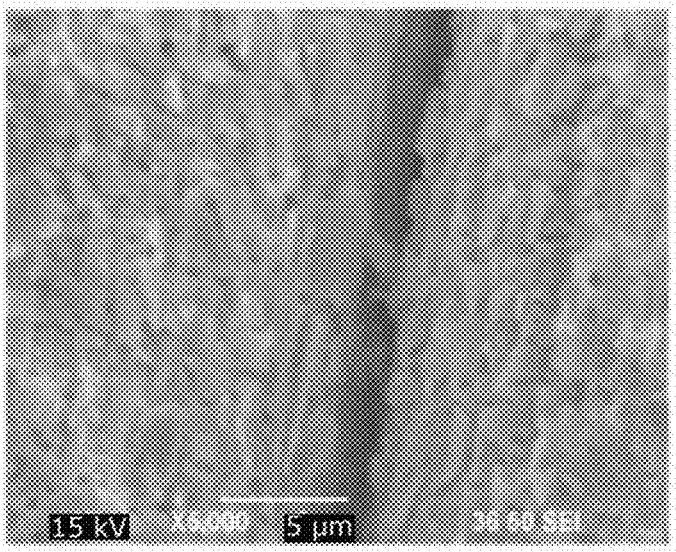
FIG. 13B is a diagram illustrating a part of FIG. 13A under magnification.

FIG. 13A is a diagram illustrating an external appearance of a tungsten wire according to Comparative Example 10 subjected to the coiling test. FIG. 13B is a diagram illustrating a part of FIG. 13A under magnification. As illustrated in FIG. 13A and FIG. 13B, in Comparative Working Example 10, although no fracturing occurred in the tungsten wire, a surface delamination occurred slightly. Therefore, although fiber product (metal mesh) 110 can be manufactured even when the elongation percentage is 4%, the elongation percentage is desirably greater than or equal to 5% for manufacturing fiber product 110 of higher quality.

It should be noted that the diameter of tungsten wire 10 and the pitch of the mesh is not limited to the above examples.

[Advantageous Effects, Etc.]

As described above, wrapped yarn 1 that is an example of a fiber product includes tungsten wire 10 having an elongation percentage greater than or equal to 5% and organic fiber 20 that is combined with tungsten wire 10.

Accordingly, elongation of tungsten wire 10 along with elongation of organic fiber 20 is facilitated, and thus it is possible to suppress the breaking of tungsten wire 10 from occurring.

Furthermore, for example, tungsten wire 10 has a diameter less than or equal to 40 μm.

Accordingly, it is easy to perform a twisting process on organic fiber 20, and it is possible to enhance productivity of wrapped yarn 1 and a fiber product manufactured using wrapped yarn 1.

Furthermore, for example, tungsten wire 10 is an alloy wire containing an alloy of tungsten and at least one type of metallic element other than tungsten. Furthermore, for example, the at least one type of metallic element is a Group 7 element or a Group 8 element.

Accordingly, the alloying element is dispersed evenly in tungsten wire 10, and thus it is possible to increase the elongation percentage while keeping the tensile strength high.

Furthermore, for example, tungsten wire 10 does not fracture when bent until a radius of curvature of the tungsten wire reaches a predetermined value less than or equal to 13.6 μm.

Accordingly, it is possible to stably manufacture a 900-mesh-equivalent metal mesh as described above.

Furthermore, for example, organic fiber 20 is at least one fiber selected from a group containing a synthetic fiber, a natural fiber, and a recycled fiber. Organic fiber 20 has an elongation percentage less than or equal to 70% when organic fiber 20 is a monofilament.

Accordingly, the elongation percentage of organic fiber 20 is not too high, which facilitates elongation of tungsten wire 10 along with the elongation of organic fiber 20 without breaking.

Furthermore, for example, tungsten wire 10 and organic fiber 20 constitute wrapped yarn 1. Wrapped yarn 1 is a covered yarn in which organic fiber 20 is a core yarn and tungsten wire 10 is a sheath yarn Accordingly, various fiber products can be manufactured using wrapped yarn 1 that includes tungsten wire 10. For example, the fiber product is one selected from a group containing a woven fabric, a knitted fabric, a braided fabric, a wrapped yarn, and a sewing-machine thread.

(Others)

Although the fabric product according to the present invention has been described above based on the forgoing embodiments, and so on, the present invention is not limited to the foregoing embodiments.

Furthermore, for example, tungsten wire 10 may be made of tungsten doped with potassium (K). The doped potassium is present at grain boundaries of the tungsten. A content percentage of the tungsten contained in tungsten wire 10 is, for example, greater than or equal to 99 wt %.

A content percentage of potassium in tungsten wire 10 is, but is not limited to, less than or equal to 0.01 wt %. For example, the content percentage of potassium in tungsten wire 10 may be greater than or equal to 0.005 wt % and less than or equal to 0.010 wt %.

A tungsten wire made of tungsten doped with potassium (potassium-doped tungsten wire) has a higher tensile strength with a decrease in its diameter. The diameter, elongation percentage, and tensile strength of the potassium-doped tungsten wire are the same as those in the embodiment mentioned above.

As described above, in a tungsten wire containing a trace quantity of potassium, grains are restrained from growing in a radial direction of the tungsten wire. That is, widths of surface grains can be reduced, and it is possible to increase the tensile strength.

The potassium-doped tungsten wire can be manufactured by the same manufacturing method as in the embodiment by using a doped tungsten powder that is doped with potassium, instead of tungsten powder.

Furthermore, for example, a surface of tungsten wire 10 may be coated with an oxide film, a nitride film, or the like.

Furthermore, for example, the embodiment described above shows wrapped yarn 1 in which one tungsten wire 10 and one organic fiber 20 are combined together. However, this is not limitative of the numbers of tungsten wires 10 and organic fibers 20 to be combined together. For example, two or more tungsten wires 10 may be combined with one organic fiber 20. Specifically, wrapped yarn 1 may be a covered yarn in which two or more tungsten wires 10 are put together and wound around one organic fiber 20 used as a core yarn. Wrapped yarn 1 may be a doubled-and-twisted yarn in which one organic fiber 20 and two or more tungsten wires 10 are twisted together.

Alternatively, one tungsten wire 10 and two or more organic fibers 20 may be combined together. Specifically, wrapped yarn 1 may be a covered yarn in which two or more organic fibers 20 are put together to form a core yarn, around which one tungsten wire 10 is wound. Wrapped yarn 1 may be a doubled-and-twisted yarn in which two or more organic fibers 20 and one tungsten wire 10 are twisted together.

Furthermore, two or more tungsten wires 10 and two or more organic fibers 20 may be combined together. Specifically, wrapped yarn 1 may be a covered yarn in which two or more organic fibers 20 are put together to form a core yarn, around which two or more tungsten wires 10 are put together and wound. Wrapped yarn 1 may be a doubled-and-twisted yarn in which two or more organic fibers 20 and two or more tungsten wires 10 are twisted together.

Furthermore, for example, wrapped yarn 1 may be manufactured using, instead of a plurality of tungsten wires 10, tungsten wire 10 and a metal wire different from tungsten wire 10. For example, a tungsten wire and a molybdenum wire may be used.

Furthermore, in a case where a plurality of organic fibers 20 are used, the plurality of organic fibers 20 may be manufactured from the same material or may be manufactured from different materials.

Furthermore, for example, the embodiment described above shows an example in which the diameter of tungsten wire 10 is smaller than the diameter of organic fiber 20. However, this is not limitative of the diameters. For example, the diameter of tungsten wire 10 may be equal to the diameter of organic fiber 20.

Aside from the above, forms obtained by various modifications to respective embodiments that can be conceived by those skilled in the art, as well as forms realized by combining constituent elements 10 in the respective embodiments, without materially departing from the spirit of the present invention are included in the present invention.

The invention claimed is:

1. A wrapped yarn comprising:

a tungsten wire having an elongation percentage greater than or equal to 5%; and an organic fiber that is combined with the tungsten wire, wherein the tungsten wire has a tungsten content percentage greater than or equal to 90 wt %, the tungsten wire is an alloy wire containing either rhenium or ruthenium, and the tungsten wire has a tensile strength greater than or equal to 1600 MPa and less than or equal to 2400 MPa, and the tungsten wire has a rhenium content percentage greater than or equal to 0.1 wt % and less than or equal to 10 wt % when the tungsten wire contains rhenium, and a ruthenium content percentage greater than or equal to 0.05 wt % and less than or equal to 0.3 wt % when the tungsten wire contains ruthenium.

2. The wrapped yarn according to claim 1, wherein the tungsten wire has a diameter less than or equal to 40 μm.

3. The wrapped yarn according to claim 1, wherein the organic fiber is at least one fiber selected from a group containing an aramid fiber, polyester, polyethylene, polypropylene, nylon, cotton, wool, silk, hemp, and rayon, and the organic fiber has an elongation percentage less than or equal to 70% when the organic fiber is a monofilament.

4. The wrapped yarn according to claim 1, wherein the wrapped yarn is a covered yarn in which the organic fiber is a core yarn and the tungsten wire is a sheath yarn.

5. A fiber product comprising the wrapped yarn according to claim 1.

6. The fiber product according to claim 5, wherein the fiber product is one selected from a group containing a woven fabric, a knitted fabric, and a braided fabric.

* * * * *